United States Patent [19]

Bennett et al.

[11] 4,174,214

[45] Nov. 13, 1979

[54] WEAR RESISTANT MAGNESIUM COMPOSITE

[75] Inventors: Foster C. Bennett; Sidney L. Couling, both of Columbus, Ohio

[73] Assignee: Rheocast Corporation, Milwaukee, Wis.

[21] Appl. No.: 907,747

[22] Filed: May 19, 1978

[51] Int. Cl.[2] ..... C22C 33/00; B32B 15/14

[52] U.S. Cl. ..... 75/168 R; 75/168 B; 148/11.5 M

[58] Field of Search ..... 75/168 R, 168 B; 148/11.5 M

[56] References Cited

U.S. PATENT DOCUMENTS

| | | | |
|---|---|---|---|
| 2,793,949 | 5/1957 | Imich | 75/135 |
| 3,098,723 | 7/1963 | Micks | 29/183.5 |
| 3,166,415 | 1/1965 | Conant | 75/202 |
| 3,460,971 | 8/1969 | Bonis et al. | 117/71 |
| 3,936,298 | 2/1976 | Mehrabian et al. | 75/134 R |
| 4,056,874 | 11/1977 | Kalnin | 75/0.5 R |

OTHER PUBLICATIONS

Milička et al., "... Mg Strengthened by Magnesia Particles" Z. Metallicde, 64, 1973, 581.

*Primary Examiner*—L. Dewayne Rutledge
*Assistant Examiner*—Upendra Roy

[57] ABSTRACT

A solid composite with a magnesium or magnesium alloy matrix with degenerate dendrites therein and up to about 30 weight percent solid, substantially insoluble oxide particles dispersed in the matrix, the oxide being selected from at least one member of the group consisting of aluminum oxide and magnesium oxide.

11 Claims, No Drawings

WEAR RESISTANT MAGNESIUM COMPOSITE

BACKGROUND OF THE INVENTION

This invention relates to magnesium metal and more in particular pertains to solid magnesium metal containing particles to improve the wear resistance of magnesium.

Solid additives have been mixed with various metals to modify the properties of the metals; see, for example, U.S. Pat. No. 3,583,471 describing carbide containing welding rods. U.S. Pat. No. 3,936,298 relates to metal composites of a base metal exhibiting thixotropic properties with metallic and/or nonmetallic particles mixed throughout the base metal.

Machining of certain composites of metals and abrasive particles has heretofore generally not been feasible by normal machining techniques because of the rapidity at which the cutting tools wear or the unavailability of cutting tools or bits with a sufficient hardness to cut the abrasive particles. Grinding such composites may be effective, but accurately grinding complex shapes is oftentimes difficult and time consuming. It is, therefore, desirable to provide a castable metal complex with a greater resistance to wear, i.e., abrasion, than the base metal which is machinable using generally available equipment.

SUMMARY OF THE INVENTION

A solid composite with a magnesium or magnesium alloy matrix with degenerate dendrites therein and up to about 30 weight percent solid, substantially insoluble oxide particles dispersed in the matrix has a substantially improved resistance to wear over the base magnesium or magnesium alloy. The oxide particles are aluminum oxide, magnesium oxide or mixtures thereof. Such a magnesium composite is suitable for, for example, use as rollers, pulleys, cylinder liners, cylinders, pistons, hoses, and the like.

DESCRIPTION OF THE PREFERRED EMBODIMENT

A light weight composite of a magnesium or, preferably, a magnesium alloy, such as magnesium-aluminum-zinc, magnesium-aluminum and magnesium-zinc alloys, with a minor amount of a metal oxide mixed therein is surprisingly both resistant to wear, or abrasion, and machinable by well-known techniques. Hereinafter, the invention will be described with reference to the preferred magnesium alloy; however, such term shall be construed to include commercially pure magnesium unless specified to the contrary. The oxide selected to mix with the magnesium or alloy thereof is preferably wetted by molten magnesium, harder than magnesium and is substantially nonreactive with the magnesium at the temperatures at which it is added. Suitable oxides for combination with the magnesium alloy are those of magnesium and preferably aluminum.

To prepare the magnesium alloy composite, a molten magnesium alloy is cooled to within the range between the liquidus and solidus temperatures of the alloy and mixed or stirred sufficiently to disrupt or break apart dendrites which form upon cooling of the metal. The metal is usually maintained within this temperature range during mixing. Mixing to form solidified disrupted, or degenerate, dendrites within a melt of magnesium alloy is carried out by, for example, as described in U.S. Pat. Nos. 3,902,544, issued Sept. 2, 1975, and 3,936,298, issued Feb. 3, 1976. For brevity, the subject matter of U.S. Pat. Nos. 3,902,544 and 3,936,298 are incorporated herein by reference.

The particles of the oxide are preferably added to the partially solidified magnesium alloy after about 15 to about 40 and preferably about 20 to about 30 weight percent of the magnesium alloy has solidified. As the oxide is added to, and mixed with, the partially solidified magnesium alloy, the temperature of the melt can be increased sufficiently to increase fluidity of the magnesium alloy and thereby permit continued agitation, such as stirring, of the mixture. When the temperature is so increased, the agitation should be sufficient to minimize settling of a substantial amount of the oxide from the magnesium alloy. Preferably the temperature increase, if any, is sufficient to maintain the total solid content of the magnesium alloy-oxide mixture at about 15 to about 40 weight percent (based on the total weight of the magnesium alloy-oxide mixture). The final temperature of the mixture can be greater or less than the liquidus temperature of the alloy.

The oxide containing partially molten magnesium alloy is cooled and solidified completely when the desired quantity of oxide has been dispersed throughout the melt. Wear resistant magnesium castings can be made from the magnesium alloy-metal oxide mixture by, for example, well-known sand, permanent mold, centrifugal and pressure die casting techniques. Generally and preferably the oxide is substantially uniformly distributed throughout the solidified casting, but centrifugal casting provides the opportunity to produce wear resistant magnesium alloy castings with a greater amount of the oxide on the peripheral portions than is present in the more centrally located portions of the casting.

Oxide particles in nominal sizes of less than about ½ inch and preferably of a size less than about 4 mesh (U.S. Standard Sieve Size) are added to the magnesium alloy. Machinability of the solidified composite is improved when the particle size is from about 0.1 to about 200 microns diameter (average diameter) and more preferably from about 5 to about 50 microns diameter. The composite castings are wear resistant when from about 1 to about 30 weight percent of the oxide is present. The preferred about 1 to about 10 weight percent oxide generally provides improved composite machinability and tensile characteristics over those obtainable when larger amounts of the oxide are employed.

Castings made from the magnesium alloy-oxide composite can be ground using common abrasive wheels, but it is surprising that they can, at especially the preferred, about 1 to about 10 weight percent oxide concentration, be machined using well-known machining equipment and techniques. It has been found to be desirable when machining to remove, or "cut", that amount of composite surface equal to about the average diameter of the oxide particle in the composite on each machining "pass".

The following examples will more fully illustrate the invention.

EXAMPLE 1

About four pounds of a standard magnesium base alloy (AZ91B) with a nominal composition of 9 weight percent aluminum, 0.7 weight percent zinc, 0.2 weight percent manganese and the balance essentially magnesium are melted and then poured into a dendrite shearing apparatus with a 4 inch diameter rotatable shearing blades suited to shear and break apart dendrites found in the AZ91B during cooling. The apparatus employed is described in more detail in a copending patent application filed by Foster C. Bennett entitled "Apparatus and Method to Form Metal Containing Nondendritic Primary Solids" and identified by Ser. No. 799,429 filed May 23, 1977, now U.S. Pat. No. 4,116,423. This application is incorporated herein by reference. U.S. Pat. Nos. 3,902,544 and 3,936,298 describe other means to shear dendrites in a molten melt of metal.

The upper surface of the molten AZ91B is slightly above the top of the rotatable shearing blades. An argon protective gas prevents the upper surface of the AZ91B from burning. The shearing blades are rotated at a speed of 300 revolutions per minute and the AZ91B cooled to 583° C. (a temperature of about 570° to about 585° C. would be satisfactory) by means of cooling coils positioned around the exterior of the shearing apparatus. At this temperature, about 23 weight percent of the AZ91B is frozen. The partially solidified metal is subjected to the shearing blades and $Al_2O_3$ powder with a nominal particle size of minus 100+200 mesh is added to the melt at a rate of about 0.04 pound per minute. This rate is equivalent to an addition of about 1 weight percent each minute. Addition of the $Al_2O_3$ continues until 0.2 pound of the $Al_2O_3$, which is preheated at about 300° C. to remove moisture, is mixed into the partially solidified AZ91B. Stirring with the shearing blades is continuous during addition of the $Al_2O_3$ and continues for 5 minutes after all the $Al_2O_3$ is added. After the $Al_2O_3$ is added, the blades are also alternately moved upwardly and downwardly during the final 5 minute stirring period to provide a substantially uniform distribution of the $Al_2O_3$ in the magnesium.

The so prepared metal is cast into approximately one pound cylindrical shapes in a graphite mold. The composite is found to be machinable and wear resistant.

EXAMPLES 2–4

In a similar manner, as described for Example 1, $Al_2O_3$ is added to AZ91B alloy in amounts of 9, 16.7, 23 and 28 weight percent of 200 micron particles. Castings made from such composites are determined to be more resistant to wear than AZ91B and to be machinable.

EXAMPLE 5

Substantially as described for Example 1, save for a metal temperature of about 600° to about 609° C., magnesium base alloy AM60A with a nominal composition of 6 weight percent aluminum, 0.4 weight percent manganese and the balance essentially magnesium is mixed with about 25 weight percent MgO having a nominal particle size of 44 microns diameter. A casting made in a graphite mold from this mixture is resistant to wear. Tensile properties of the cast composite are ultimate strength: 26,700 psi, yield strength: 19,600 psi and elongation: 0.5 percent.

What is claimed is:

1. A solid composite with a magnesium or magnesium alloy matrix with degenerate dendrites therein and up to about 30 weight percent solid, substantially insoluble oxide particles dispersed in the matrix, the oxide being selected from at least one member of the group consisting of aluminum oxide and magnesium oxide.

2. The composite of claim 1 wherein the particles are aluminum oxide.

3. The composite of claim 2 wherein the particle size is up to about ½ inch diameter.

4. The composite of claim 2 wherein the particle size is from about 0.1 to about 200 microns diameter.

5. The composite of claim 2 wherein the composite contains from about 1 to about 30 weight percent aluminum oxide.

6. The composite of claim 2 wherein the composite contains from about 1 to about 10 weight percent aluminum oxide.

7. The composite of claim 6 wherein the particle size is from about 0.1 to about 200 microns diameter.

8. The composite of claim 7 wherein the aluminum oxide powder is substantially uniformly dispersed throughout the magnesium alloy.

9. A method to form wear resistant magnesium or magnesium alloy comprising sequentially:

cooling a molten magnesium or magnesium alloy metal to within a temperature range between the liquidus and solidus temperatures of the metal;

agitating the cooled molten metal sufficiently to form degenerate dendrites;

mixing up to about 30 weight percent solid, substantially insoluble oxide particles into the molten metal to provide a substantially uniform dispersion of the particles in the metal, the oxide being selected from at least one member of the group consisting of aluminum oxide and magnesium oxide; and solidifying the mixture.

10. The method of claim 9 including mixing from about 1 to about 10 weight percent aluminum oxide powder of a size within the range of from about 0.1 to about 200 microns diameter into the metal to provide, when solid, a wear resistant composite.

11. The method of claim 10 wherein the powder size is from about 5 to about 50 microns diameter.

* * * * *